US007189108B2

(12) United States Patent
Takaya et al.

(10) Patent No.: US 7,189,108 B2
(45) Date of Patent: Mar. 13, 2007

(54) ELECTRONIC DEVICE TERMINAL CONNECTOR

(75) Inventors: Kouetsu Takaya, Kanagawa (JP); Hideki Daijima, Kanagawa (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 10/538,917

(22) PCT Filed: Aug. 22, 2003

(86) PCT No.: PCT/JP03/10639

§ 371 (c)(1),
(2), (4) Date: Apr. 11, 2006

(87) PCT Pub. No.: WO2004/053912

PCT Pub. Date: Jun. 24, 2004

(65) Prior Publication Data

US 2006/0211299 A1 Sep. 21, 2006

(30) Foreign Application Priority Data

Dec. 11, 2002 (JP) ..... 2002-359733

(51) Int. Cl.
*H01R 31/08* (2006.01)

(52) U.S. Cl. ..... 439/511

(58) Field of Classification Search ..... 439/511, 439/509, 507

See application file for complete search history.

(56) References Cited

FOREIGN PATENT DOCUMENTS

| | | |
|---|---|---|
| AT | 366854 | 5/1982 |
| CH | 684721 | 11/1994 |
| DE | 1959962 | 6/1970 |
| DE | 2912944 | 10/1980 |
| EP | 1291977 | 3/2003 |
| ES | 2081243 | 2/1996 |
| FR | 2647272 | 11/1990 |
| JP | 59-22736 | 7/1984 |
| JP | 08-251779 | 9/1996 |
| JP | 08-251781 | 9/1996 |
| JP | 11-122755 | 4/1999 |

*Primary Examiner*—Javaid H. Nasri
(74) *Attorney, Agent, or Firm*—Rabin & Berdo, P.C.

(57) ABSTRACT

In a terminal connection apparatus by which the space between terminals, such as the terminals of two adjacent electromagnetic contactors, is bridged by three-phase terminal connection conductors arranged in the order of the phases or in the order of phase switching to realize a motor reversing operation, load switching, power source switching or the like, the three-phase terminal connection conductors are housed in a box-shaped insulation case for unitization. As a result, the terminal connection conductors are collectively surrounded by the insulation case to protect the insulation. At the same time, the terminal connection conductors are connected to an electrical device in a unitized manner, thus preventing wrong wiring operation when they are connected.

6 Claims, 8 Drawing Sheets

ELECTRONIC DEVICE TERMINAL CONNECTOR

BACKGROUND OF THE INVENTION

1. Field of the Invention

The present invention relates to a terminal connection apparatus for bridging between terminals of neighboring electrical devices (e.g., contactors (relays), on/off devices).

2. Prior Art

According to a known arrangement, when a motor is normal/reverse-operated, or when one power source is connected to two loads in a switching manner, or when two power sources are connected to one load in a switching manner, two electromagnetic contactors (relays) or two similar on/off devices are provided so as to be physically adjacent to each other, and a terminal connection apparatus is used for bridging the terminals of these devices using terminal connection conductors. FIGS. 5A, 5B and 5C illustrate wiring diagrams of a three-pole electromagnetic contactor in various applications using such a terminal connection apparatus.

FIG. 5A shows the connection in which two electromagnetic contactors 1 are used to perform normal/reverse operation of a motor. Here, with regard to the power source side, the space between the two terminals 1, the space between the two terminals 3, and the space between the two terminals 5 are bridged by the terminal connection conductors 2, 3, and 4 in the order of phases (i.e., the same phases are bridged). With regard to the load side, the space between terminals 2 and 6, the space between the two terminals 4, and the space between terminals 6 and 2 are bridged by the terminal connection conductors 5, 6, and 7 in the order in which the phases are switched, i.e., to be bridged so that two of the three phases are interchanged. As is well known, a three-phase AC motor can provide normal/reverse rotation by switching two among three of the phases R, S, and T. Thus, treating the condition in which the electromagnetic. contactor 1 at the left of FIG. 5A is in the "ON" condition as normal rotation, then reverse rotation is provided when the right side is in the "ON" condition. Similar switching also can be provided when the power source side and the load side are switched directly.

FIG. 5B shows two electromagnetic contactors 1 used to switch two loads A and B, in which the power source side is bridged in the order of the phases. When the left side of FIG. 5B is turned ON, then the load A is supplied with power and, when the right side is turned ON, then the load B is supplied with power. FIG. 5C shows two electromagnetic contactors 1 used to switch two power sources A and B, in which the load side is bridged in the order of the phases. When the left side of FIG. 5C is turned ON, the power source A is supplied to the load and, when the right side is turned ON, the power source B is supplied to the load.

FIGS. 6A and 6B show an example in which a conventional terminal connection apparatus is used to provide a reversible type electromagnetic contactor for the normal/reverse operation of a motor, where FIG. 6A is a side view and FIG. 6B is a front view. Two electromagnetic contactors 1 are provided on an attachment base 8 so as to be adjacent to each other and are interlocked by a mechanical interlock apparatus 9 so that the two contactors are not turned ON at the same time. As shown, the space between the terminals at the power source side (upper side) is bridged by the terminal connection conductors 5 to 7 in the order of the switching of the phases, while the space between the terminals at the load side (lower side) is bridged by the terminal connection conductors 2 to 4 in the order of the phases.

FIGS. 7A, 7B and 7C are respectively a side view, a front view and a lower face view of a terminal connection conductor, such as the terminal connection conductor 2 in FIGS. 6A and 6B, in the exemplary conventional terminal connection apparatus. The terminal connection conductor 2 consists of a U-shaped conductor punched out of a plate material, both ends of which are bent at a right angle to provide a terminal section 2*a*. The space between the terminal sections 2*a* is covered by an insulation material 10. The insulation material 10 is applied, for example, with a polyethylene resin immersion coating or a powder insulation coating.

FIGS. 8A, 8B and 8C are respectively a side view, a front view and a lower face view of another example of the terminal connection conductor 2 in FIGS. 6A and 6B. Here, terminal connection conductor 2 has the same structure as that of FIGS. 7A, 7B and 7C, but the former is different from the latter in that the insulation material 10 is formed by a tube that contracts when subjected to heat. In FIGS. 6A and 6B, for the purpose of saving space, the terminal connection conductor 3 is provided to have a Ω-like shape and the terminal connection conductor 6 is provided to have a strip-like shape, and they are connected to the terminal connection conductors 2 and 4 and the terminal connection conductors 5 and 7 so as to be perpendicular thereto.

Spanish Patent Publication No. ES2081243 discloses a different conventional technique in a terminal connection apparatus for bridging the terminals of two electrical devices provided to be adjacent to each other. This apparatus is designed so that an electrical insulation element having a groove for guiding an electric wire is provided, and an electric wire is inserted in the groove for bridging between the terminals.

If the terminal connection conductor of FIGS. 7A, 7B and 7C is coated for insulation by an immersion coating or a powder insulation coating, the insulation coating can be applied, as shown, up to the root of the terminal section. However, a problem arises in that the insulation coating material needs to be dried for a long time, so it has poor workability. In contrast, in the terminal connection conductor of FIGS. 8A, 8B and 8C using a thermal contraction tube, when compared to the conventional example of FIGS. 7A, 7B and 7C, the insulation coating has superior workability. such a thermal contraction tube tends to develop wrinkles during contraction, and the corner section where the conductor is bent in particular tends to have a complicated shape due to the wrinkles. In view of this, when a thermal contraction tube is used, conventional techniques have prevented such a conductor bend section from being maximally insulation-coated, so that the insulation coating is provided only in the middle part of the U-shaped section (see FIGS. 8A, 8B and 8C). Thus, the conductor is exposed in a wider area, which runs the risk of a short-circuit when this exposed part comes in contact with a conductive foreign material (e.g., scraps of electric wire), or of causing an electric shock if contacted by a finger, for example. The terminal connection apparatus for reversible operation of FIGS. 6A and 6B also has a problem of incorrect wiring because six terminal connection conductors must be connected separately.

On the other hand, with the apparatus according to Spanish Patent Publication No. ES2081243 in which an electric wire is inserted to the groove of an electrical insulation element, exposed electric wiring is contained in a narrower space, which reduces the risk of electric shocks. This apparatus also has an advantage that the wiring can be arranged with more precision because terminals can be connected after all electric wires have been retained by electrical insulation elements. However, grooves in which electric wires are inserted require different routing patterns in accordance with the wiring type (e.g., order of phase, phase switching), thus increasing the complexity of the layout process. A deeper groove for providing an enhanced insulation also tends to cause deformation of the resin-formed electrical insulation element, which may cause a problem in inserting the wiring into the groove. Such a groove also creates a risk that the insulation of an electrical insulation element may deteriorate from dust or the like, because the groove in the electrical insulation element is in an "open" condition before an electrical wire is inserted.

The present invention is intended to solve these problems. It is an objective of the invention to improve the insulation of the terminal connection conductor, to prevent incorrect wiring, and to simplify the wiring work and the management of components.

SUMMARY OF THE INVENTION

In order to solve the above problems, according to the invention, a terminal connection apparatus for electrical devices is provided in which the terminal connection apparatus has terminal connection conductors for a plurality of phases for bridging terminals of two adjacent electrical devices. The terminal connection conductor has terminal sections at both ends for connection to the terminals of the electrical devices. The terminal connection conductor is U-shaped and the space between the terminal sections is covered by an insulation material. An insulation case, housing the terminal connection conductors, collectively surrounds the terminal connection conductors for a plurality of phases, except for the terminal sections, to provide unitization. This enables the insulation of the terminal connection conductors to be completely protected from the exterior. Also, since each of the terminal connection conductors can be covered with insulation in the minimum range required for interphase insulation, this permits use of a thermal contraction tube to minimize the amount of insulation covering utilized and simplifying the insulation covering operation. Further, the terminal connection conductors for a plurality of phases are connected after having been unitized by the insulation case, which reduces the likelihood that the wiring operation will be performed incorrectly. Further yet, the insulation case may have a box-like shape to collectively house the terminal connection conductors for a plurality of phases, and thus can be widely used regardless of the wiring type (e.g., phase order wiring, phase switching order wiring). Furthermore, the insulation case is sealed by a cover body, thus preventing the insulation from deteriorating due to an ingress of dust or the like.

According to another aspect of the invention, the terminal connection conductors are formed of a plate material, and are provided to be parallel to one another in the direction of plate thickness. This allows the entire configuration to be retained more securely than that of a terminal connection conductor of the prior art using an electric wire, and also enables the apparatus to be thinner.

According to still another aspect of the invention, with the insulation case including a box-shaped body having an opening at the upper face, and with terminal connection conductors of a plate material provided to be parallel to one another in the direction of plate thickness, the box-shaped body has notches at the upper edge for the respective conductors. Each notch is engaged with a terminal section of the respective terminal connection conductor. The case also includes a plate-shaped cover body engaging the box-shaped body and covering the opening at the upper face. The terminal connection conductors that are inserted in the body and in which the terminal sections thereof are projected via the notches, are pressed by the cover body to be fixed. This allows an insulation case having a simple structure to enable the terminal connection conductors to be positioned according to need, and the complete protection of the insulation by surrounding the terminal connection conductors.

According to a further aspect of the invention, the terminal connection conductors are covered by thermal contraction tubes. This covering may be provided in the range required for interphase insulation, while for the exposed terminal connection conductor parts, the insulation case provides protection.

BRIEF DESCRIPTION OF THE DRAWINGS

FIG. 5A shows motor reversible operation, FIG. 5B shows load switching, and FIG. 5C shows power source switching.

DETAILED DESCRIPTION OF THE PREFERRED EMBODIMENT

Figure 1:
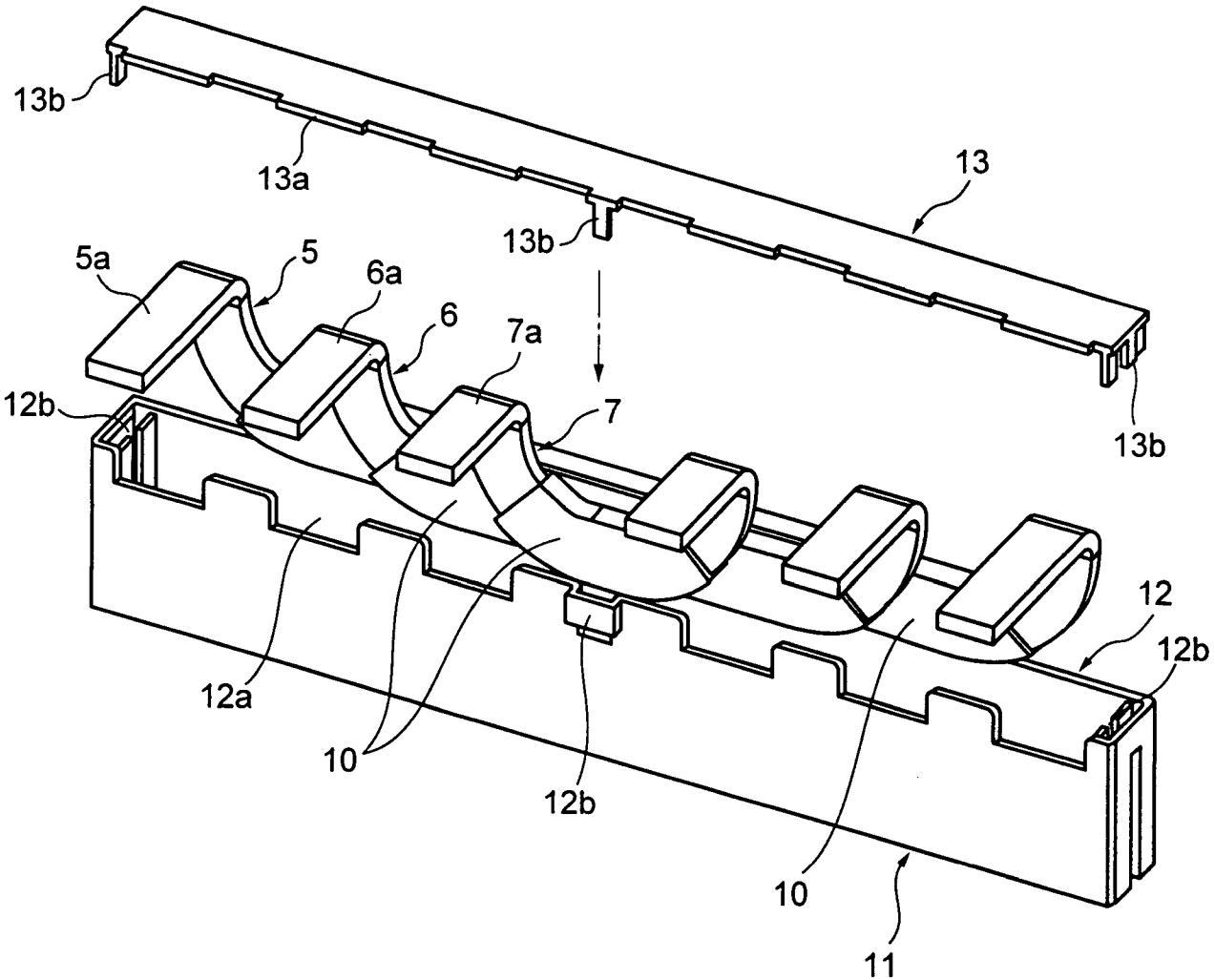
FIG. 1 is an exploded perspective view of a phase switching terminal connection apparatus illustrating an embodiment of the invention.
Figure 2:
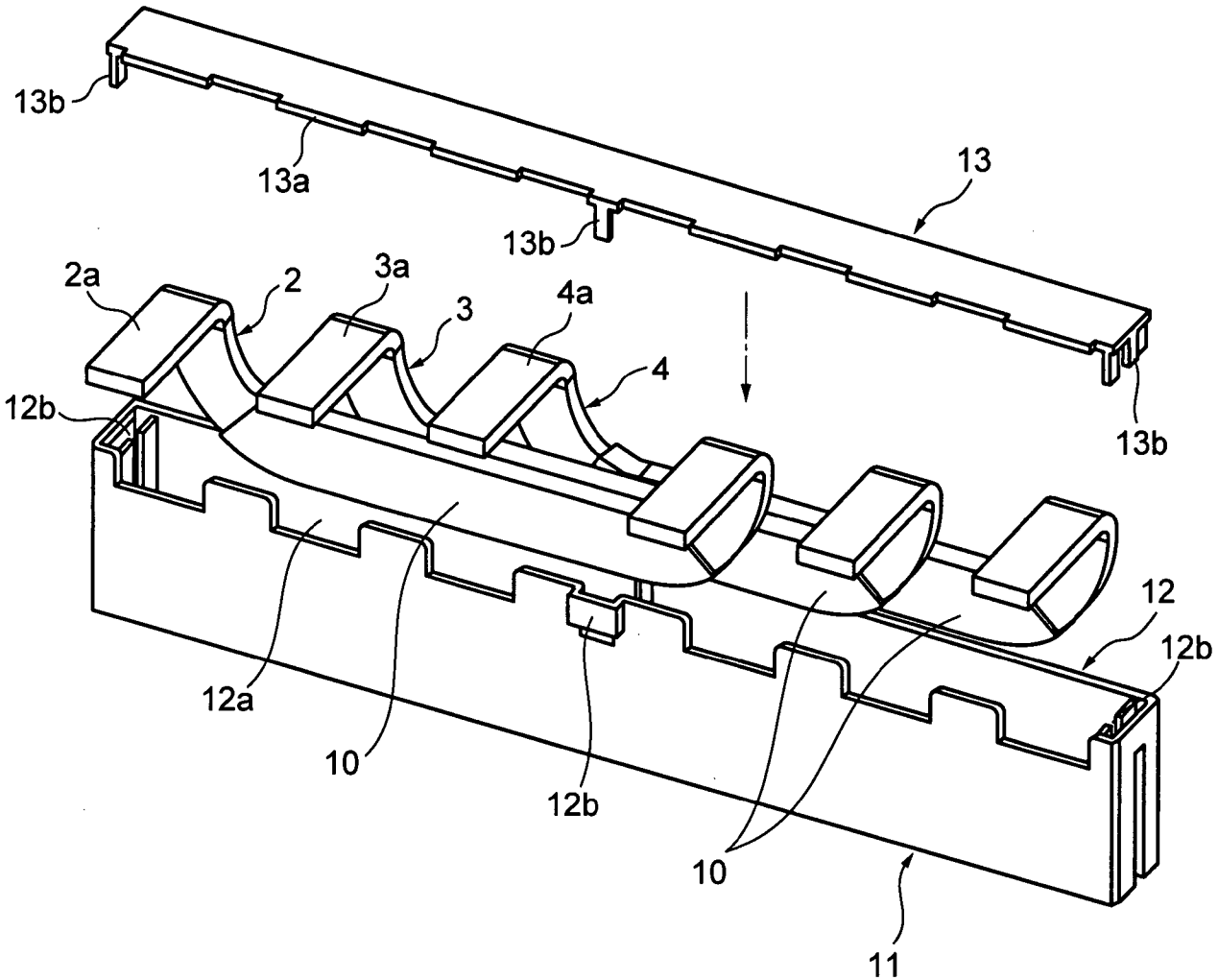
FIG. 2 is an exploded perspective view of a phase order terminal connection apparatus illustrating an embodiment of the invention.
Figure 3:
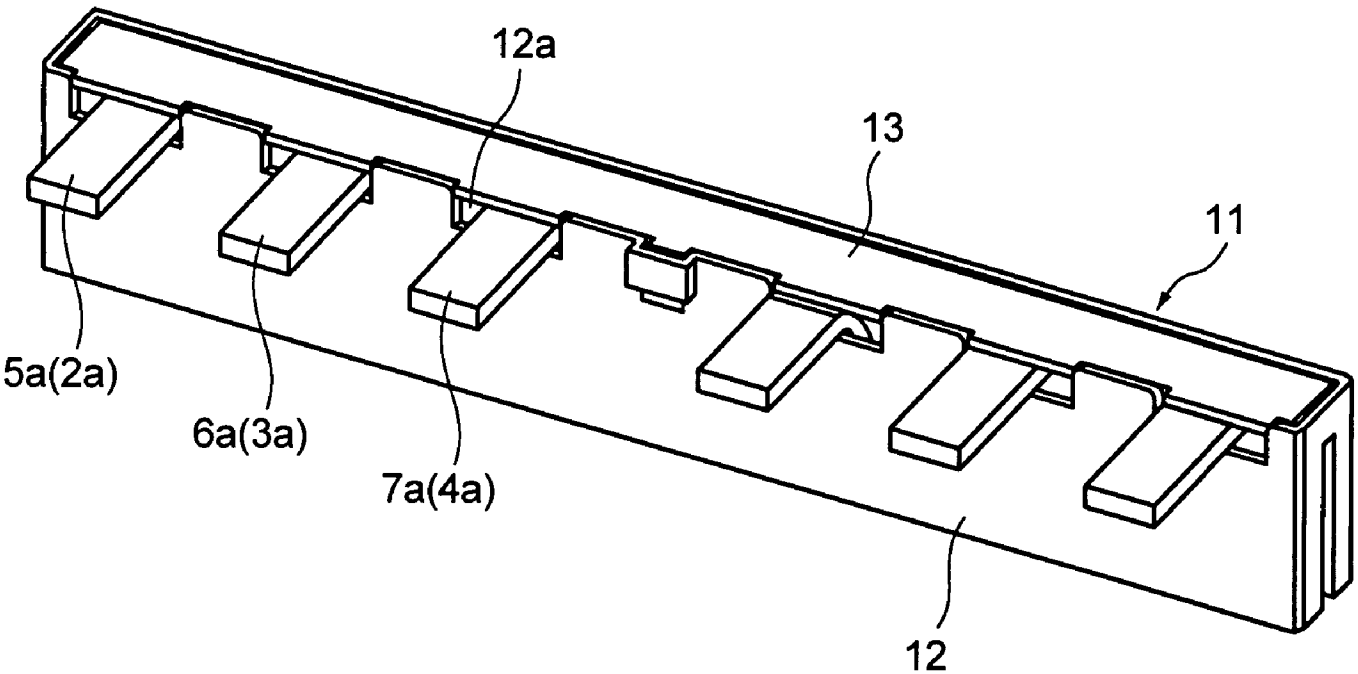
FIG. 3 is a perspective view illustrating the appearance of the terminal connection apparatus of FIG. 1 or FIG. 2.
Figure 4B:
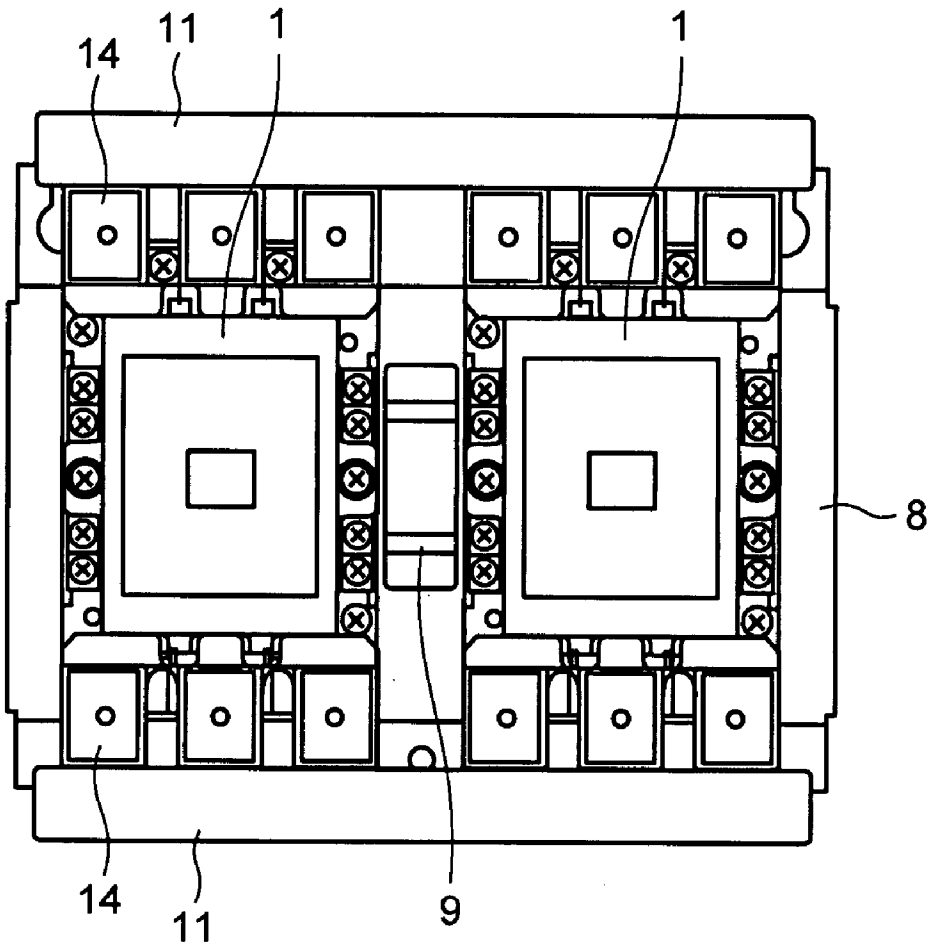
FIGS. 4A and 4B are respectively a side view and a front view of an electromagnetic contactor using the terminal of FIG. 1 or FIG. 2.
Figure 4A:
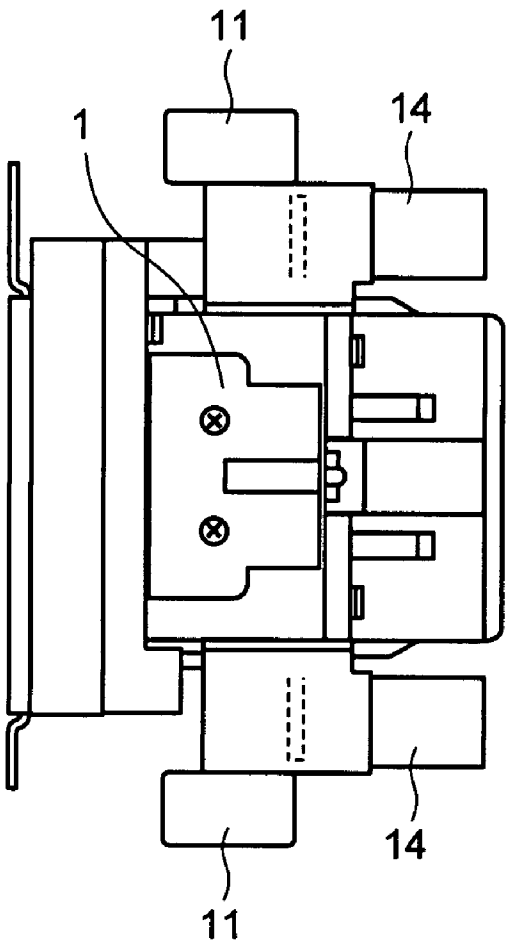
Figure 5A:
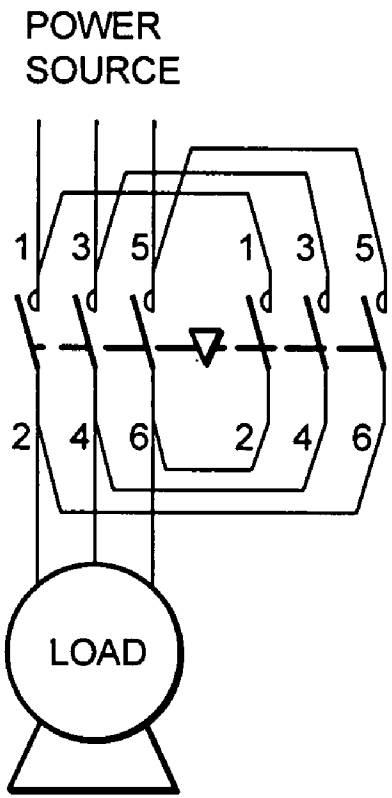
FIG. 5A PRIOR ART
FIGS. 5A–5C show a wiring diagram of a tripolar electromagnetic contactor using the terminal connection apparatus, where
Figure 5B:
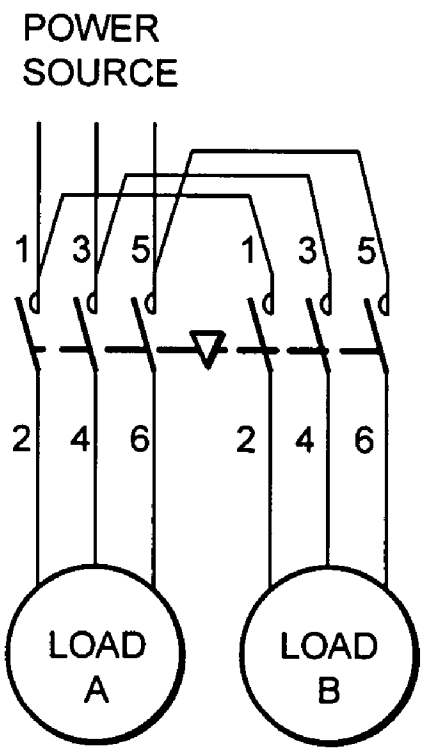
FIG. 5B PRIOR ART
Figure 5C:
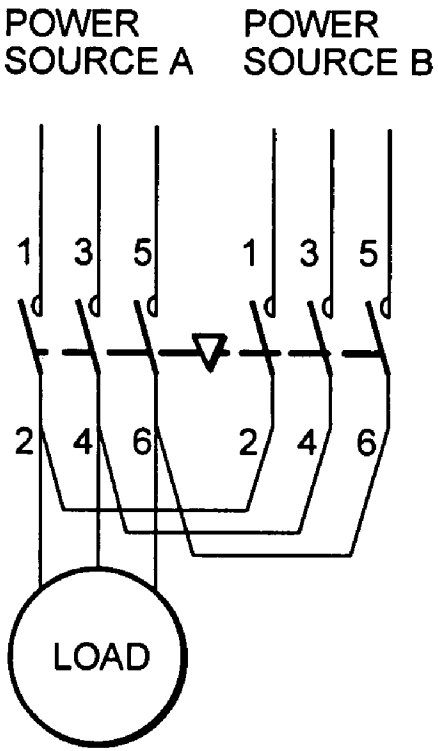
FIG. 5C PRIOR ART
Figure 6B:
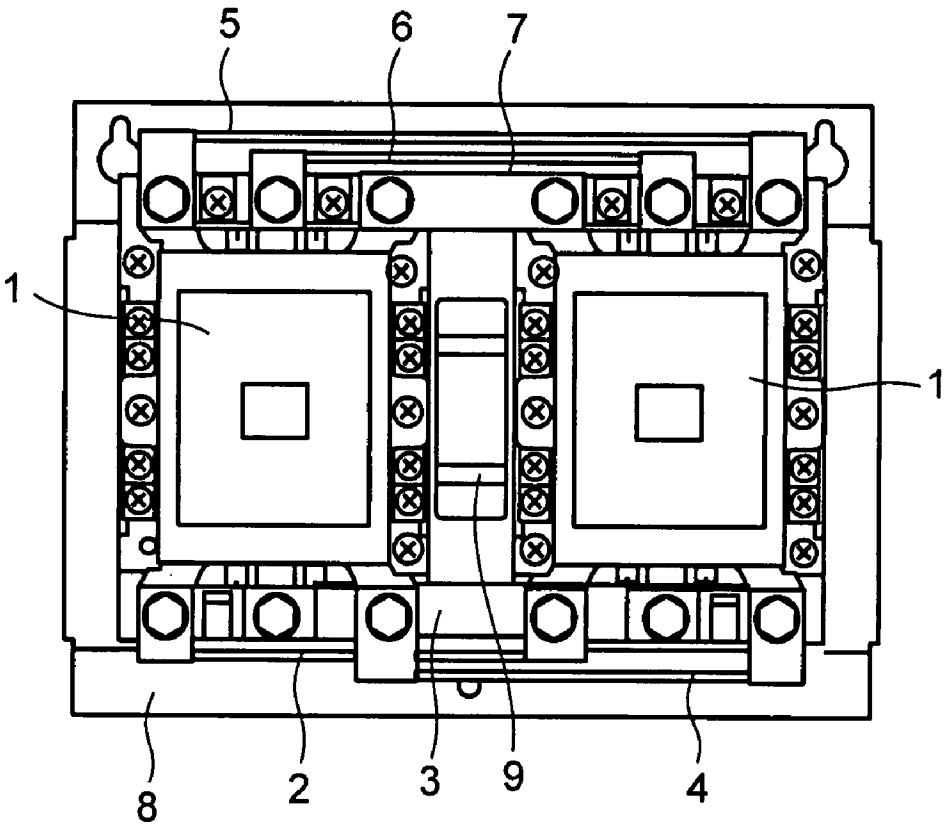
FIG. 6B PRIOR ART
FIGS. 6A and 6B are respectively a side view and a front view of an electromagnetic contactor using a conventional terminal connection apparatus.
Figure 6A:
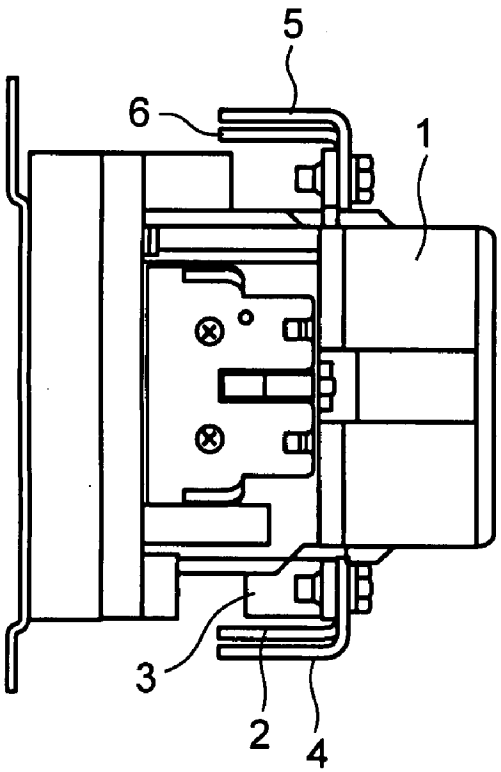
FIG. 6A PRIOR ART
Figures 7A, 7B, 7C:
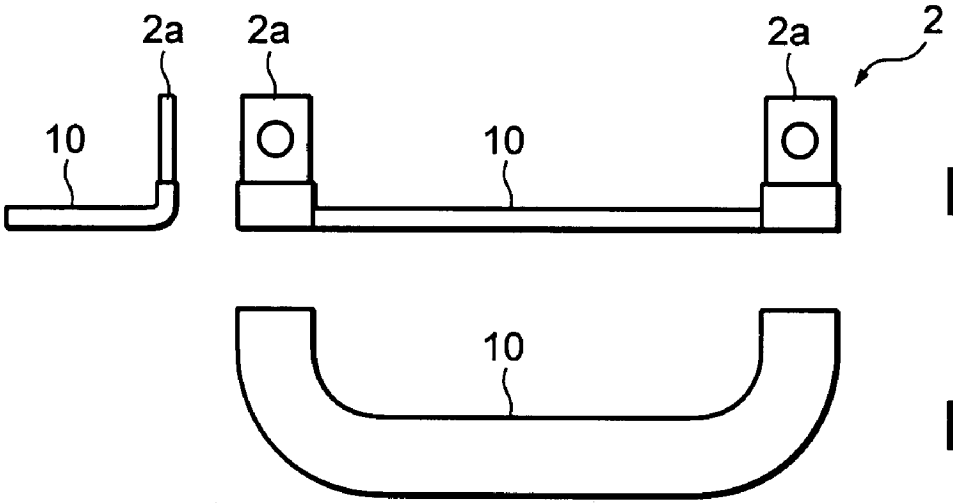
FIG. 7A PRIOR ART
FIG. 7B PRIOR ART
FIG. 7C PRIOR ART
FIGS. 7A, 7B and 7C are respectively a side view, a front view and a lower face view of a terminal connection conductor in a conventional terminal connection apparatus.
Figures 8A, 8B, 8C:
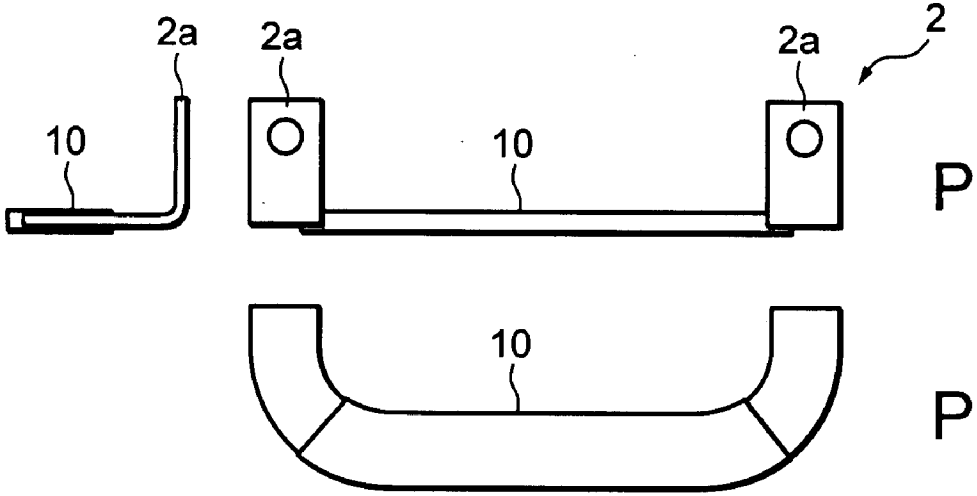
FIG. 8A PRIOR ART
FIG. 8B PRIOR ART
FIG. 8C PRIOR ART
FIGS. 8A, 8B and 8C are respectively a side view, a front view and a lower face view of a different terminal connection conductor in a conventional terminal connection apparatus.

Hereinafter, with reference to FIGS. 1 to 4B, an embodiment of this invention will be described. FIG. 1 is an exploded perspective view of a terminal connection apparatus of a phase switching connection. FIG. 2 is an exploded perspective view of a terminal connection apparatus of phase order connection. FIG. 3 is a perspective view illustrating the appearance of the apparatus of FIG. 1 or FIG. 2. FIG. 4A is a side view of an electromagnetic contactor for reversible operation using the apparatus of FIG. 1 or FIG. 2. FIG. 4B is the front view. In the drawings, the same components as those of the conventional example are denoted with the same reference numerals.

In FIG. 1 and FIG. 2, the terminal connection conductors 2 to 7 each consist of a U-shaped conductor pressed out of a plate material and both ends thereof are bent at a right angle to provide terminal sections 2*a* to 7*a*. The conductor part, except for the terminal sections 2*a* to 7*a*, is covered by an insulation material 10 consisting of a thermal contraction tube. The insulation covering 10 covers, as shown in the drawing, only up to the middle of the U-bend part of the conductor for the minimum covering required to provide the interphase insulation of the terminal connection conductors 2 to 7. This suppresses the creation of wrinkles during thermal contraction.

The terminal connection conductors 2 to 7 for a plurality of phases (three-phase in the drawing) are collectively surrounded, except for the terminal sections 2*a* to 7*a*, by the insulation case 11 consisting of a molded resin. The insulation case 11 consists of a box-shaped body 12 having at the upper face an opening, and a plate-shaped cover body 13 for covering the opening. The upper edge of the front face of the body 12 has six notches 12*a* engaged with the terminal sections 2*a* to 7*a* of the terminal connection conductors 2 to 7. The center of the front face and both ends thereof have an engagement section 12*b* engaged with the cover body 13. On the other hand, the cover body 13 has, at the front edge thereof, six protruding sections 13*a* engaged with the notches 12*a* of the body 12 and engagement projections 13*b* are provided to correspond to the engagement section 12*b* of the body 12.

As shown in FIG. 1 and FIG. 2, the above-described terminal connection conductors 2 to 7 are attached by superimposing them so as to be parallel to one another in the direction of plate thickness, to insert them in the body 12 while engaging the terminal sections 2*a* to 7*a* with the notches 12*a*. Then, the protruding sections 13*a* are engaged with the notches 12*a* to engage the cover body 13 to the opening of the body 12, thereby engaging the engagement projection 13*b* with the engagement section 12*b* in a snap fit manner. As a result, the terminal connection conductors 2 to 7 housed in the body 12 are positioned by the notches 12*a* via the terminal sections 2*a* to 7*a* and are pressed and fixed by the cover body 13. This allows the terminal connection conductors 2 to 7 for the respective phases to be integrally unitized via the insulation case. FIG. 3 shows the terminal connection apparatus unitized in this manner.

The terminal connection apparatus of FIG. 3 in this condition is placed on the two electromagnetic contactors 1 shown in FIG. 4 to be connected in the manner shown to bridge the spaces of the terminals for the respective phases. In FIG. 4, the upper side is the power source side to which the terminal connection apparatus of a phase order connection type shown in FIG. 1 is connected, while the lower side is the load side to which the terminal connection apparatus of phase switching connection type shown in FIG. 2 is connected. As a result, the left and right electromagnetic contactors 1 are alternately turned ON as described above, thereby switching the normal/reverse operation of a motor (not shown). The terminal connection apparatus is tightened to the main terminal of the electromagnetic contactors 1 via the block terminal 14, as shown in FIG. 4. This structure will not be described in detail because the block terminal 14 is not material to the present invention.

With reference to the described embodiment, the terminal connection conductor of the invention has the following advantages over the conventional structures.

(1) The terminal connection conductors 2 to 7 are collectively surrounded by the insulation case 11. This prevents accidents, such as short-circuiting caused when an exposed part is adhered with foreign material or an electric shock due to contact with a finger, even when the terminal connection conductors 2 to 7 have an exposed conductor.

(2) For the same reason as describe in (1) above, the terminal connection conductors 2 to 7 can have an exposed conductor to the maximum allowable limit in terms of preventing interphase short-circuiting, thus suppressing wrinkles from thermal contraction by minimizing the insulation covering of the U-bend part of the conductor, even when a thermal contraction tube that can be covered easily is used.

(3) The terminal connection conductors 2 to 7 can be connected to the electromagnetic contactor 1 while being unitized in an integral manner, thus simplifying the wiring operation and preventing it from being performed incorrectly.

(4) The insulation case 11 is entirely sealed and thus the insulation at the inner side is protected from deterioration.

(5) The box-shaped insulation case 11 only surrounds the terminal connection conductors 2 to 7 from the exterior, and does not have complicated rib or grooved structures, so that it easily can be resin-formed and made resistant to deformation.

(6) The box-shaped insulation case 11 can be commonly used for both of the phase order connection and the phase switching connection.

The invention claimed is:

1. A terminal connection apparatus for electrical devices, comprising

U-shaped terminal connection conductors for a plurality of phases for bridging between the terminals of two adjacent electrical devices, the terminal connection conductors having opposite ends and terminal sections at the opposite ends for connection to the terminals of the electrical devices, a space between the terminal sections being covered by an insulation material; and an insulation case collectively surrounding the terminal connection conductors for a plurality of phases except for the terminal sections, and the insulation case housing the terminal connection conductors for unitization.

2. A terminal connection apparatus for electrical devices according to claim 1, wherein the terminal connection conductors are formed of a plate material and are disposed in parallel to one another in a direction of plate thickness.

3. A terminal connection apparatus for electrical devices according to claim 2, wherein the insulation case includes a box-shaped body having an opening at an upper face thereof and a plurality of notches at an upper edge, the notches being engaged with the terminal sections of the terminal connection conductors, and a plate-shaped cover body engaged with the box-shaped body and covering the opening, the terminal connection conductors being inserted into the body, the terminal sections projecting from the box-shaped body via the notches and pressed by the cover body to be fixed.

4. A terminal connection apparatus for electrical devices according to claim 2, wherein at least one of the terminal connection conductors is insulation-covered by a thermal contraction tube.

5. A terminal connection apparatus for electrical devices according to claim 2, wherein the insulation case includes a box-shaped body having an opening at an upper face thereof and notches at an upper edge, the notches being engaged with the terminal sections of the terminal connection conductors, and a plate-shaped cover body engaged with the box-shaped body and covering the opening, the terminal connection conductors being inserted to the body, the terminal sections projecting from the box-shaped body via the notches and pressed by the cover body to be fixed.

6. A terminal connection apparatus for electrical devices according to claim 2, wherein the terminal connection conductors are insulation-covered by respective thermal contraction tubes.

* * * * *